United States Patent [19]

Kossmann et al.

[11] Patent Number: 4,908,153

[45] Date of Patent: Mar. 13, 1990

[54] TRANSPORT APPARATUS FOR ELECTROCOATING MACHINES

[75] Inventors: Hans Kossmann, Palatine; Frank J. Herdzina, Schaumburg, both of Ill.

[73] Assignee: Service Tool Die & Mfg. Company, Elk Grove Village, Ill.

[21] Appl. No.: 190,879

[22] Filed: May 6, 1988

[51] Int. Cl.[4] ..... C25D 13/12; B65G 29/00; B05C 13/02

[52] U.S. Cl. ..... 204/300 EC; 204/299 EC; 204/199; 204/212; 198/803.8; 198/803.12; 118/426; 118/503

[58] Field of Search ..... 204/299 EC, 300 EC, 204/180.7, 180.2, 181.1, 181.2, 181.3, 180.6, 181.4, 198, 199, 201, 202, 203, 204, 205, 212, 213, 214, 215, 216, 217, 218, 181.6, 181.7; 198/803.8, 803.12, 470.1; 413/18, 19, 60; 118/503, 423, 426

[56] References Cited

U.S. PATENT DOCUMENTS

| | | | |
|---|---|---|---|
| 2,381,502 | 8/1945 | Lang | 198/803.8 X |
| 2,939,572 | 6/1960 | Wurgaft | 198/470.1 |
| 3,120,892 | 2/1964 | Henning et al. | 198/803.8 |
| 3,128,119 | 4/1964 | Walter | 198/803.8 |
| 3,759,810 | 9/1973 | Landauer et al. | 204/181.1 |
| 3,847,786 | 11/1974 | Landauer et al. | 204/300 EC |
| 4,005,000 | 1/1977 | Kraska | 204/300 EC X |
| 4,081,344 | 3/1978 | Shindou et al. | 204/181.4 X |
| 4,752,172 | 6/1988 | Bolte | 204/300 EC X |

*Primary Examiner*—John F. Niebling
*Assistant Examiner*—John S. Starsiak, Jr.
*Attorney, Agent, or Firm*—Kinzer, Plyer, Dorn, McEachran & Jambor

[57] ABSTRACT

An electrocoating machine has a frame supporting a series of tanks containing solutions for electrocoating work pieces such as can ends. A wheel is mounted for rotation on the frame and has a plurality of work piece holders spaced about its periphery. Each work piece holder has a pair of spaced, flexible fingers, each having a free end which is cantilevered from the wheel. As the wheel rotates, cams displace the free ends of the fingers at a point shortly before they enter the electrocoating tank. A work piece transfer apparatus places a work piece adjacent the displaced fingers at a pickup point. The cams then release the fingers so they engage the work piece in spring-loaded gripping relation. The wheel carries work pieces from the pickup point, down into the electrocoating solution and then to a rinse conveyor.

21 Claims, 6 Drawing Sheets

8
90
96
92
167
172
174
162
176
178
180
86
182
80
76
72
70
184
81
188
171
190
A
7
102
160
82
163
159
158
156
161
88
34
36
38
98

TRANSPORT APPARATUS FOR ELECTROCOATING MACHINES

BACKGROUND OF THE INVENTION

This invention relates generally to transport apparatus for electrocoating machines. It is particularly concerned with an electrocating machine for applying a repair coat on easy-open can ends after they have been formed. The need for a repair coat is known in the art. U.S. Pat. Nos. 3,759,810; 4,081,344 and 4,005,000 disclose apparatus for applying a repair coat to can ends. The present invention constitutes an improvement in the apparatus for transporting ends through the electrocoating solution while accommodating the necessary electrical current flow.

A particular drawback of the prior art has been the complexity of the holders which grip the ends while they are transported through the bath. These complex devices tend to become fouled with the electrocoating solution and as a result their reliability suffers.

SUMMARY OF THE INVENTION

This invention relates to apparatus for transporting articles and is particularly concerned with conveying relatively flat articles, such as easy-open can ends, through an electrocoating solution. One of the advantages of the invention is a simple, reliable mechanism for holding the articles as they are transported.

The transport apparatus of the present invention has a wheel rotatable on a frame. The wheel is partially disposed within a tank or vat filled with electrocoating solution A plurality of work piece holders are formed around the periphery of the wheel. Work pieces are transferred to the work holders at a pickup point, carried through the electrocoating solution, and passed on to a rinse conveyor. The work piece holders are supplied with electrical conductors and an electrode for supplying the necessary electric current The work holders themselves comprise a pair of spaced, flexible fingers. In a preferred arrangement, the fingers are flat strips of metal, in the form of a rule. The fingers are attached to the wheel intermediate the ends of the fingers, such that they define two free ends which are cantilevered from the wheel. Thus, the free ends of the fingers are flexible.

As a particular work holder approaches the pickup point, a set of cams flex the fingers away from their normal, rest position. A transfer conveyor transfers work pieces to the pickup point and places a work piece adjacent the flexed free ends of the fingers. When the cams release the fingers, the fingers tend to return to their normal rest positions, but are constrained from doing so by the presence of the work piece. Thus, the work pieces are held in spring-loaded, gripping relation by the fingers. In the case of easy-open can ends, the free ends of the fingers become disposed between the vertical wall and the curl of the end. The cams displace the fingers toward each other so upon release they tend to flex outwardly against the curl of the end, thereby retaining the end on the fingers.

Electrical conductors are fed through the wheel's hub to one of the fingers at each work piece holder There is also an electrode located at each holder connected to a conductor. The conductors terminate at brushes which are engageable with a pair of arcuate busses The busses supply electrical power to the brushes. The brushes and busses are arranged so that electric current flows only when an associated work piece holder is immersed in the electrocoating solution.

DETAILED DESCRIPTION OF THE INVENTION

Figure 1:
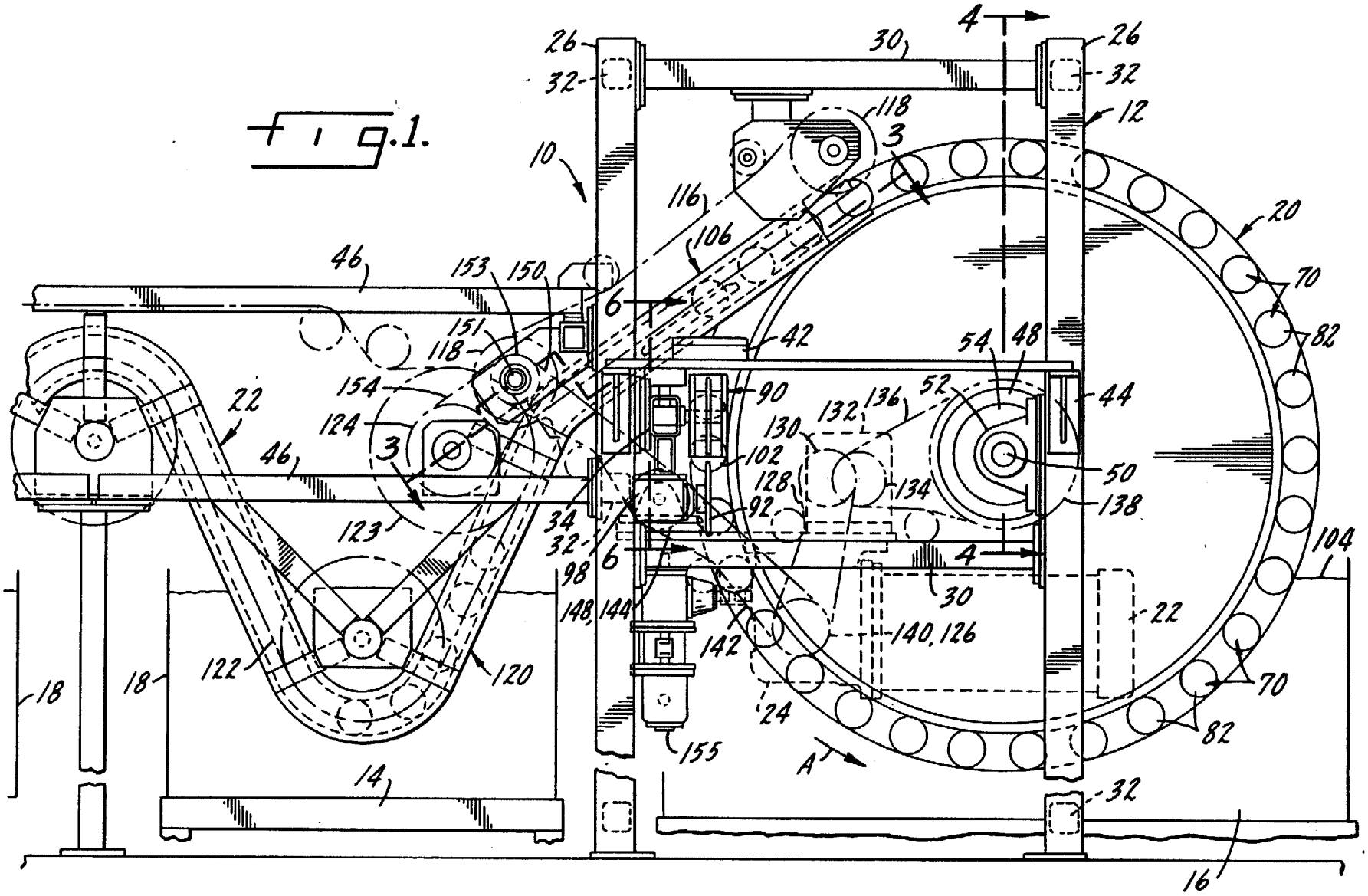
FIG. 1 is a side elevation view of the transporting device for carrying articles through an electrocoating tank, according to the present invention.

The electrocoating apparatus of the present invention is shown generally at 10 in FIG. 1. The apparatus comprises a frame mounted on the floor and including a conveyor support rack or frame 12 and tank supports 14. An electrocoating tank 16 is mounted on one of the supports 14. One or more rinse tanks 18 are mounted on supports 14 downstream of the electrocoating tank 16.

A conveyor system is provided for transporting articles or work pieces into and through an electrocoating solution in the tank 16, and from there through rinsing solutions in the rinse tanks 18. The conveyor system includes a wheel shown generally at 20 which is rotatably mounted on the conveyor frame 12. The wheel is disposed partially within the electrocoating solution in tank 16. Work piece holders attached to the wheel carry easy-open can ends or other articles as the wheel rotates. Thus, articles are subject to electrode position of the coating material as they pass through the coating tank. Coated articles are then passed to a rinse conveyor, shown generally at 22. The rinse conveyor carries coated work pieces through the series of rinse tanks 18 in a serpentine manner. Once the work pieces are rinsed, they exit the machine for further processing as appropriate. The conveyor system is driven by a motor 22 through a main gear box 24 and associated drive chains, shafts and gear boxes, as will be described below. For reference purposes, the wheel 20 has a diameter of about five feet.

Figure 2:
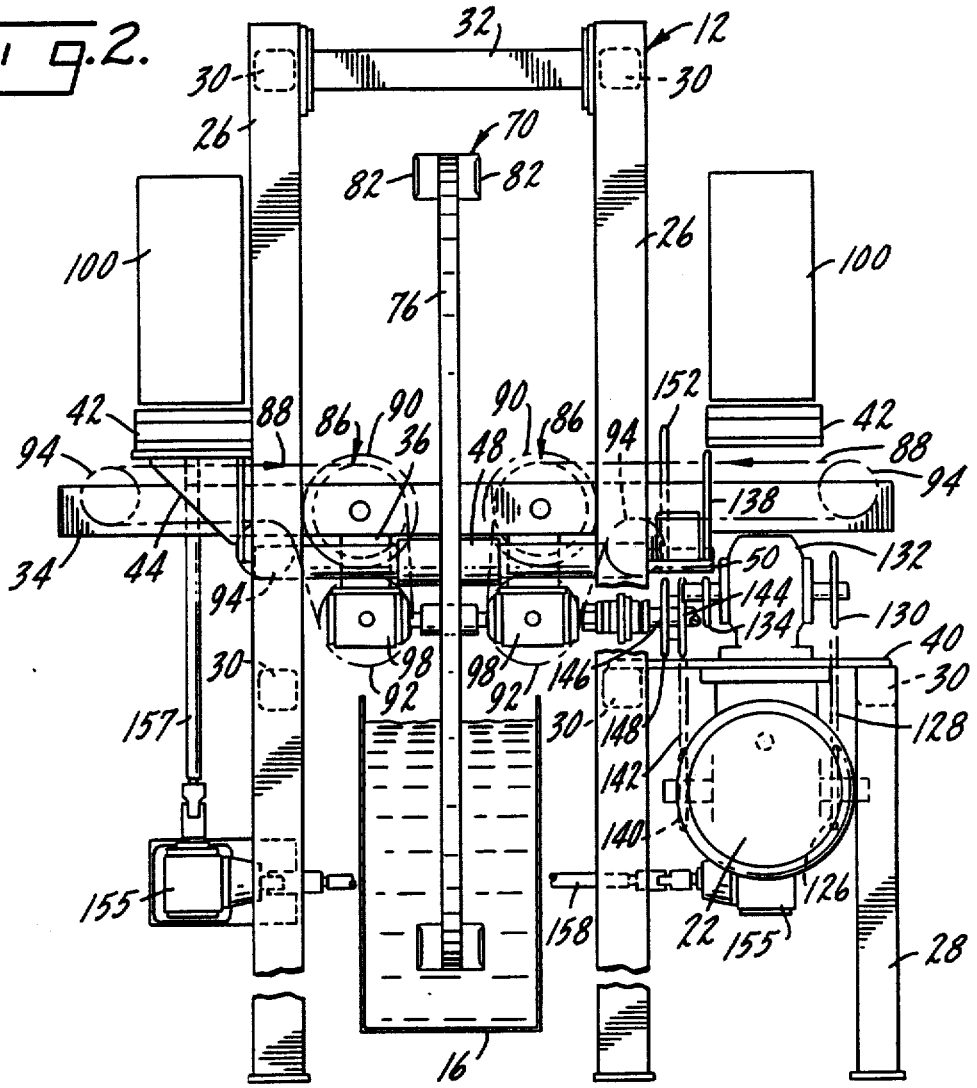
FIG. 2 is an end elevation view of the electrocoating apparatus, looking from the right side of FIG. 1.

Turning now to FIGS. 1-4, details of the conveyor system are shown. The frame 12 includes four main uprights 26 and a pair of smaller posts 28 (FIG. 2). These are tied together by longitudinal beams 30 and cross ties 32. The frame also includes a transverse box beam 34 welded to two of the uprights 26. The box beam 34 supports a similar beam 36, which in turn carries a gear box pad 38. The frame further includes a motor mounting plate 40 which is attached to two of the beams 30. Feeder platforms 42 extend between two of the uprights 26, supported by brackets 44. The frame also has longitudinal rails 46 associated with the rinsing areas of the conveyor system.

Figure 4:
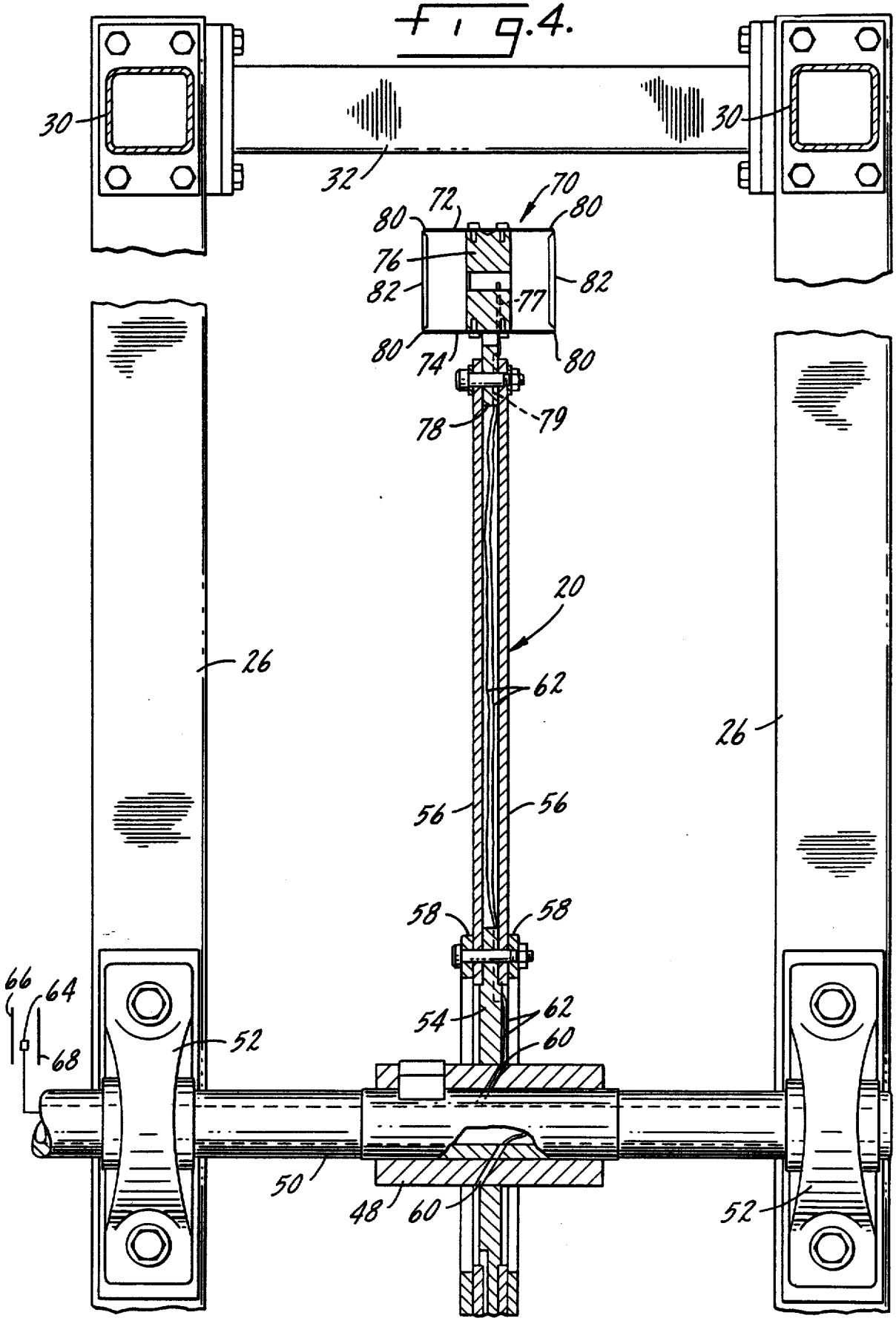
FIG. 4 is a section taken along line 4—4 of FIG. 1.
Figure 5:
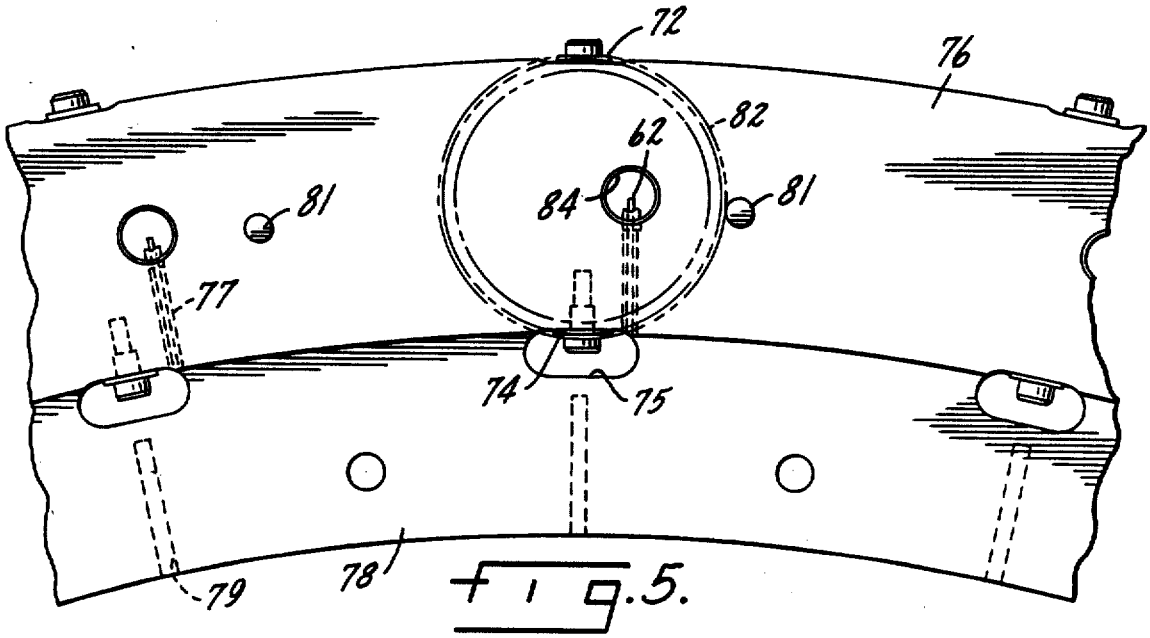
FIG. 5 is an enlarged partial view of the wheel.

The construction of the wheel 20 is shown in greater detail in FIGS. 4 and 5. The wheel has a hub 48 keyed to a shaft 50, which is supported in pillow blocks 52, which in turn are bolted to uprights 26. The hub 48 has a spacer 54 attached to it. The wheel 20 further includes a pair of annular disks or panels 56 which are bolted to the spacer 54 and retained by a pair of clamping rings 58. The disks 56 may be made of phenolic laminate, such as Ryertex C.

As seen in FIG. 4, the hub 48 and spacer 54 have passages 60 which accommodate electrical wires shown schematically at 62. The wires extend through the center of the shaft 50 and terminate at one end at a plurality of arcuately-spaced brushes, shown schematically at 64. The brushes are arranged to be engageable with one of two electrical busses, which are shown diagrammatically at 66 and 68. The busses are connected to a voltage source (not shown). The wires 62 extend from brushes 64 through the space between the wheel disks 56 to the periphery thereof. There is a pair of wires associated with each work piece holder.

A plurality of work piece holders 70 are spaced about the outer edges of the wheel 20. Each work piece holder comprises outer and inner fingers, 72 and 74, respectively. The fingers are bolted intermediate their ends to a rim 76. The rim includes a base portion 78 which is bolted to the outer edges of the disks 56. The inner finger 74 extends through a opening 75 formed at the junction between the rim 76 and base 78. The rim 76 and base 78 have passages 77 and 79 which accommodate the wires 62. The work piece holder also further includes a pin 81 extending through the rim 76. The pin engages the trailing edge of a work piece placed on the fingers.

It can be seen that the fingers 72, 74 are cantilevered from the wheel, defining free ends 80 of the fingers. The free ends 80 of the fingers engage the work pieces. In the embodiment shown, the work pieces are easy-open can ends 82.

Each work piece holder 70 also has an electrode 84 (FIG. 5) extending through the rim 76. The electrode is simply a piece of thin-wall tubing having one of the wires 62 extending through passage 77 into contact with the electrode. The other wire 62 of the pair extending to each work piece holder is attached to the inner finger 74. Depending on the polarity of the voltage applied to the busses 66 and 68, the inner finger 74 and electrode 84 will form the anode and cathode for the electrode position process. In a preferred arrangement, the finger 74 is the anode and the electrode 84 is the cathode.

Returning now to FIGS. 1 and 2, the transfer means for placing work pieces adjacent the fingers at a pickup point will now be described. The transfer means includes two separate sets of feeder systems 86, one on either side of the wheel 20. The feeder systems are generally mirror images of each other, as best seen in FIG. 2. Each feeder 86 has a transfer chain 88 revolving around a feeder wheel 90, a drive sprocket 92 and idlers 94. The feeder wheels 90 are mounted on shafts 96 extending from the box beam 34. The drive sprockets 92 are attached to right angle gear boxes 98, which in turn are mounted underneath the pads 38. The transfer chain 88 receives work pieces from rotary down-stackers, shown schematically at 100, mounted on feeder platforms 42. The down-stackers are conventional. Further details of the transfer chain 88 will be described below.

Looking at FIG. 1, the transfer means places work pieces adjacent the wheel 20 at a pickup assembly. The can end shown at 102 is located at the pickup point. The wheel 20 rotates in a counterclockwise direction as shown by arrow A. Thus, work pieces are carried through the electrocoating solution 104 in tank 16. The electrical busses are arranged so that they make contact with the brushes only during such time as the work pieces are immersed in the bath 104. As the work pieces continue around the top of the wheel, they are removed at an exit conveyor, shown generally at 106.

Figure 3:
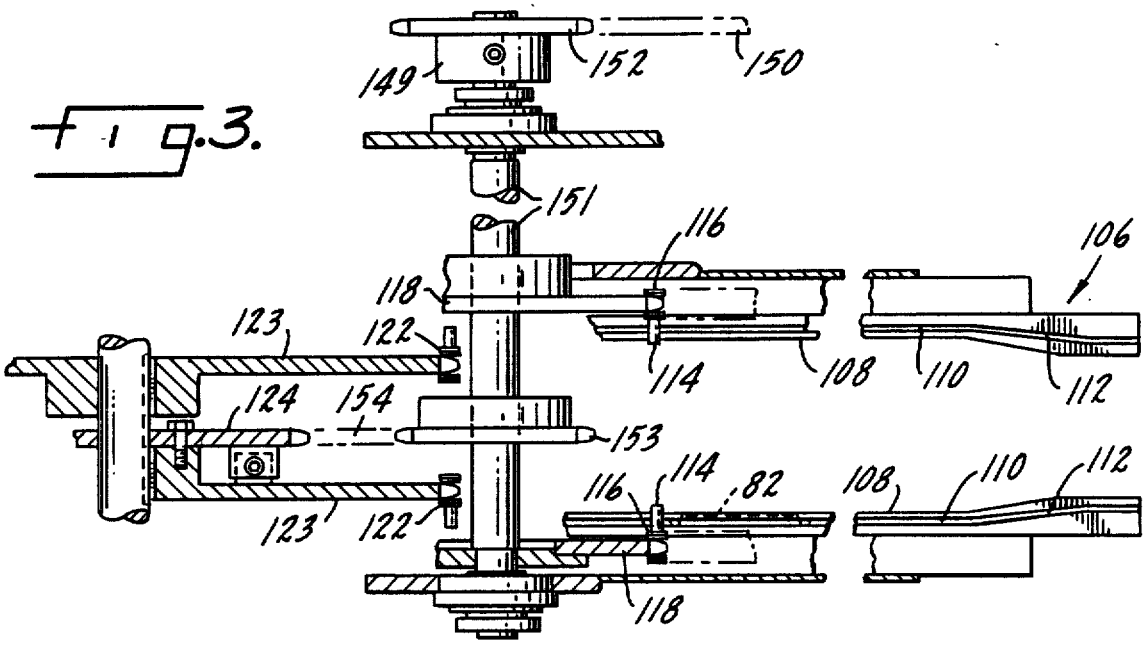
FIG. 3 is a section taken generally along line 3—3 of FIG. 1.

The exit conveyor 106 is shown in FIGS. 1 and 3. The exit conveyor has a pair of rails 108 which define tracks 110. The work pieces enter these tracks and are pulled off the ends of the fingers by virtue of the jog or camming surface 112 in the tracks 110 (see FIG. 3). Once the work pieces are removed from the fingers, they simply roll down the tracks 110 to the extent permitted by spacing fingers 114. These fingers are carried by a discharge chain 116, which revolves around sprockets 118. After leaving the exit conveyor 106, work pieces enter the rinse conveyor, shown generally at 120 in FIG. 1. The rinse conveyor comprises rails, similar to those shown at 108, with rinse chains 122 carried by sprockets 123. The sprockets 123 are mounted on a common shaft with a drive sprocket 124. The chains carry pins for spacing and pushing the work pieces along the track of the rinse conveyor.

The drive arrangements for the various components will now be described. The motor 22 is radially mounted on the main gear box 24, which in turn is suspended underneath the plate 40. The gear box 24 has dual output shafts, one of which mounts sprocket 126 (FIG. 2). Chain 128 drives sprocket 130 on the input shaft to a gear box 132. The output shaft of gear box 132 drives sprocket 134, chain 136 and a wheel drive sprocket 138. Sprocket 138 is mounted on the wheel shaft 50 in driving relation therewith.

The sprocket 140 on the second output shaft of the main gear box 24 engages a chain 142 which drives gear 144. Gear 144 drives a shaft 146, which powers the right angle drives 98 in the feeder systems 86. A second gear 148 on shaft 146 drives the discharge conveyor through chain 150 and sprocket 152. Sprocket 152 is mounted on a common shaft 151 with the discharge conveyor chain sprockets 118 (FIG. 3). Sprocket 152 has a collar 149 which is adjustably connected to shaft 151 to control the timing between the various drive chains. Sprocket 153, also mounted on shaft 151, drives the rinse conveyor sprocket 124 through chain 154. The rotary down-stackers 100 are driven through gear boxes 155 and drive shafts 157.

Figure 7:
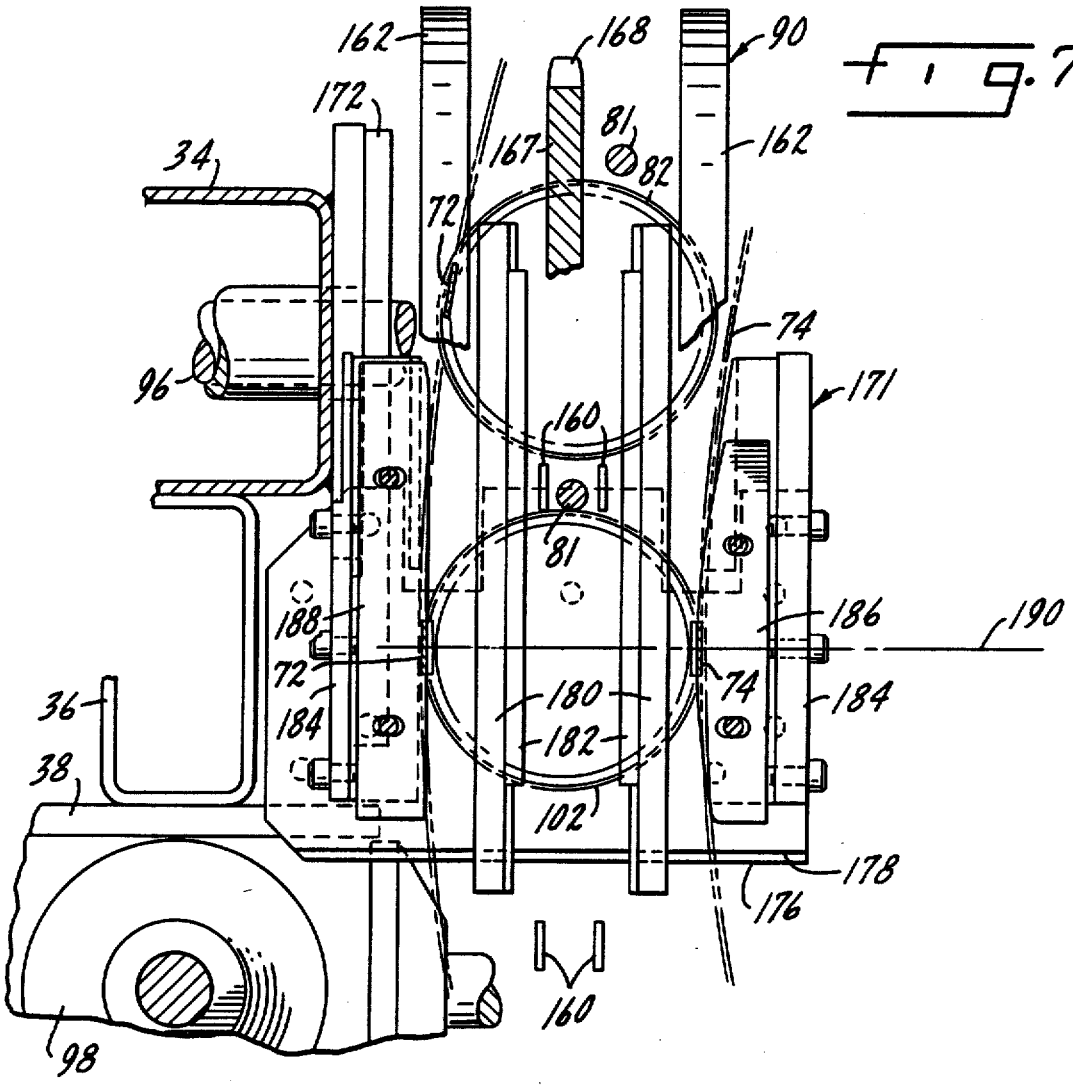
FIG. 7 is an elevation view looking along line 7—7 of FIG. 6.
Figure 6:
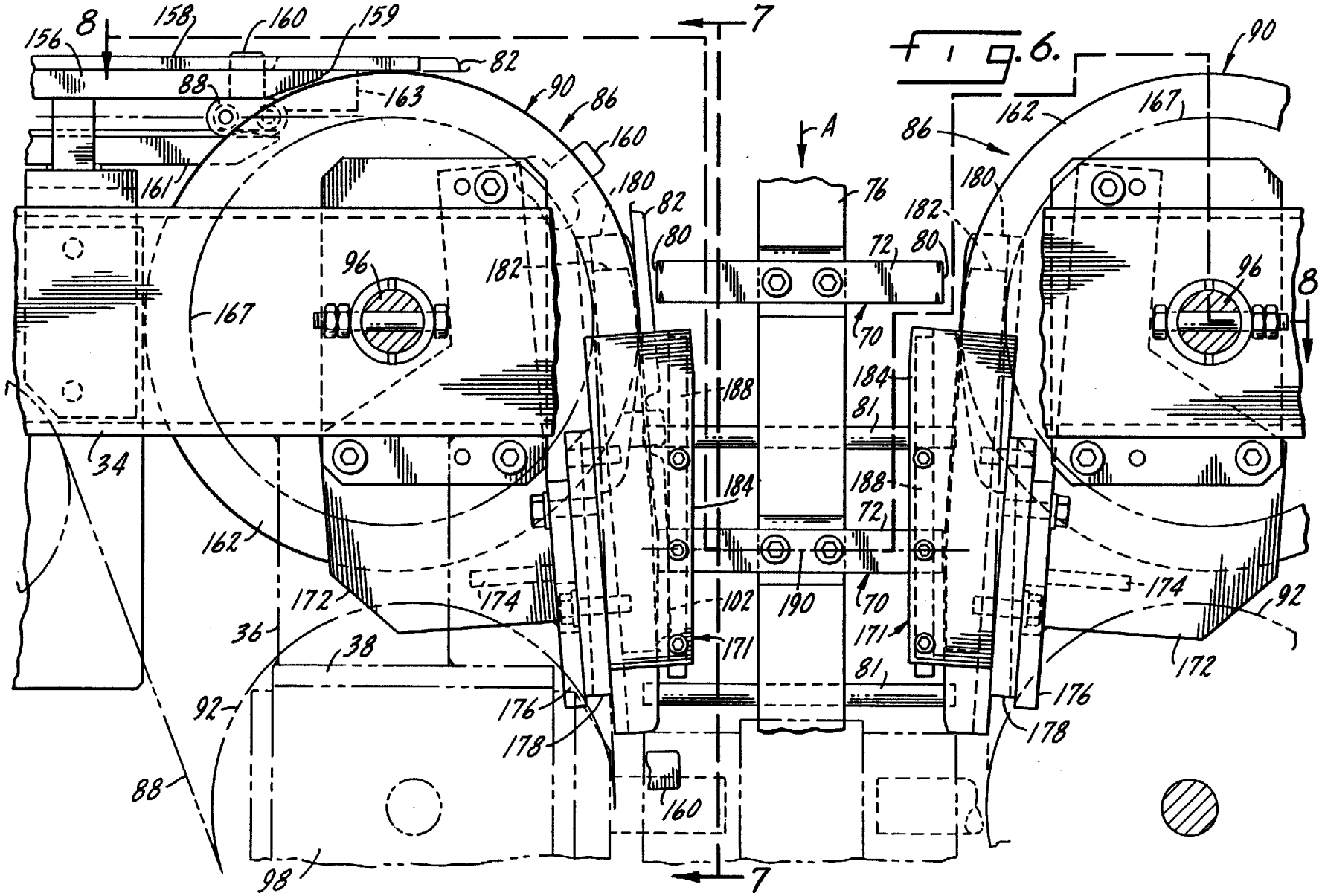
FIG. 6 is an elevation view looking in the direction of line 6—6 of FIG. 1, with the rinse conveyor removed for clarity.
Figures 8, 9, 10, 11:
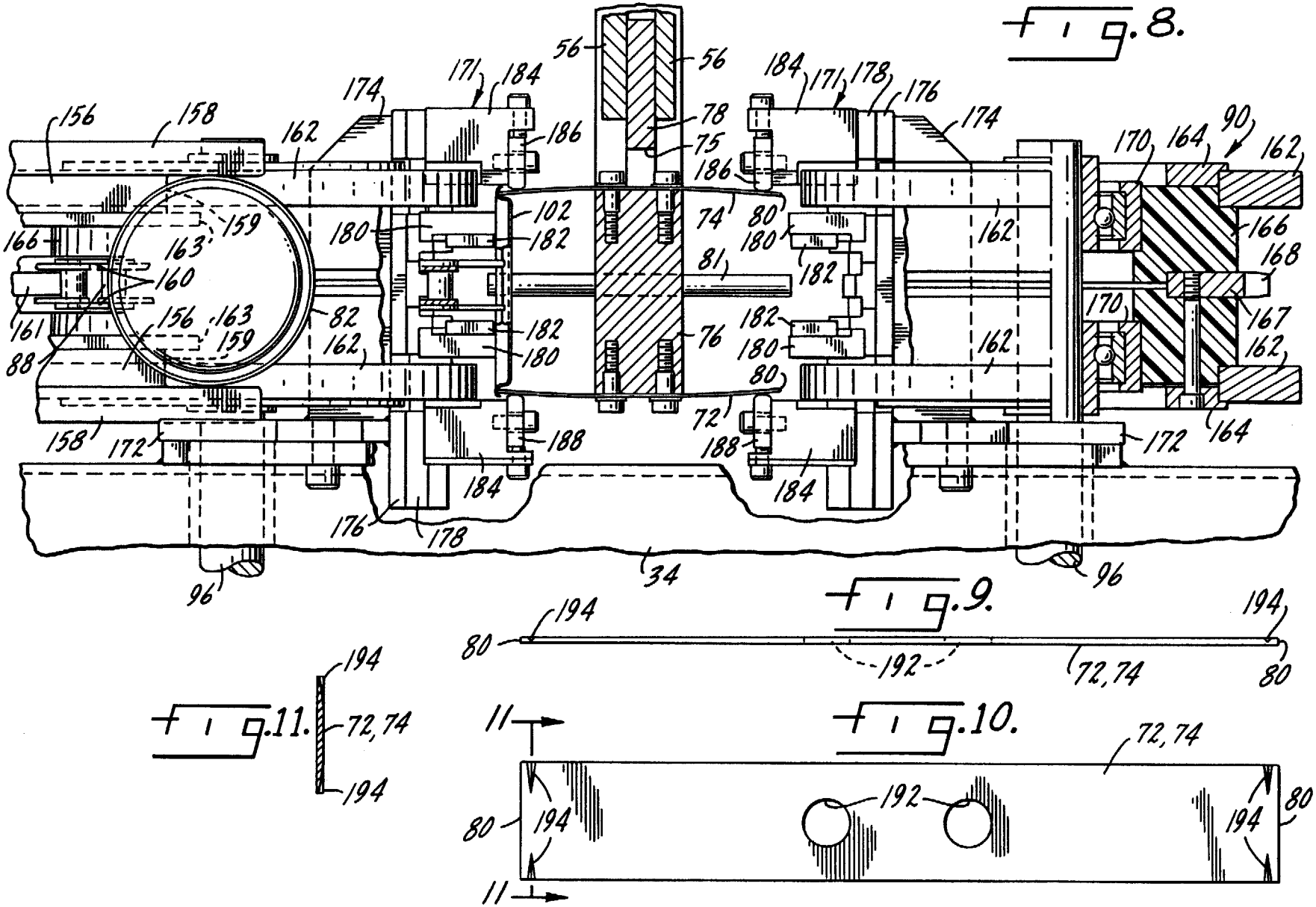
FIG. 8 is a plan view, with parts in section, of the work piece transfer conveyor at the area of the pickup point, as viewed along line 8—8 of FIG. 6.
FIG. 9 is an edge view of a finger.
FIG. 10 is a plan view of FIG. 9.
FIG. 11 is a section along line 11—11 of FIG. 10.

The transfer means including feeder systems 86 and pickup assemblies for mounting work pieces on the work piece holders are shown in greater detail in FIGS. 6–8. The rotary down-stackers deposit work pieces on support rails 156. The support rails end at 159. Side guides 158 constrain the edges of the work pieces 82 and magnets 163 prevent the ends from flying off the rails. The work pieces are pushed along the rails 156 by dogs 160 carried by the transfer conveyor chain 88. The chain is supported on a runner 161.

When the dogs 160 push a work piece off the end 159 of the support rail 156, the piece is picked up by the feeder wheel 90. The construction of the feeder wheel is best seen in FIG. 8. Each wheel has a pair of annular magnets 162 clamped between outer plates 164 and a two-piece, central core member 166. The core is made of non-magnetic material to isolate the magnets 162. The core supports a sprocket 167 which has teeth 168 to engage the chain 88. The chain 88 drives the feeder wheel about shaft 96 on bearings 170. It will be noted that the pitch circle of the teeth 168 is less than the outer diameter of the magnets 162.

The feeder wheel carries work pieces 82 to the pickup assembly indicated generally at 171. The pickup assembly is fastened to the box beam 34. It includes a bracket having a base 172, an extension 174 and a support member 176. The support 176 of the bracket carries a pair of spacers or shim plates 178. The shim plates 178 mount a pair of rails 180 which have magnetic inserts 182. The shim plates further mount a pair of cam supports 184. Inside and outside cams 186 and 188 are mounted on the cam supports 184. It will be noted in FIGS. 7 and 8 that the support member 176 of the bracket, the shim plates 178 and the cam supports 184 have cutouts or slots to provide clearance for the feeder wheel magnets 162.

FIGS. 9–11 illustrate details of the fingers 72,74. Each finger has a pair of mounting holes 192. The free ends 80 of the fingers have a pair of notches 194. These are generally V-shaped notches extending partially across the width of the finger and partially through its thickness (see FIGS. 9 and 10). As shown in FIG. 11, the notches are cut arcuately into the thickness of the finger. The purpose of the notches is to facilitate engagement of the finger with the curl of the easy-open can ends 82.

The use, operation and function of the invention are as follows. The rotary down-stackers 100 successively place individual work pieces (in this case, can ends 82) on the support rails 156. As the transfer chain 88 revolves, it brings a dog 160 into contact with the edge of a can end 82 to push the end along the support rail toward the feeder wheel 90. Guide rails 158 provide lateral restraint as the end moves along the rails. When the dog 160 pushes the work piece off the end of the support rail, the work piece engages the magnets 162 of the feeder wheel. The magnets then carry the work piece around the corner toward the pickup assembly 171. That is, the can end is transferred from an essentially horizontal orientation to a vertical orientation. Since the outside diameter of the magnets 162 is greater than the pitch circle of the transfer chain 88, the linear speed of the end is greater than that of the dog 160. This advances the end ahead of the dog, as best seen in FIG. 6.

As the magnets 162 advance the end 82 into the top of the pickup assembly, the end engages the rails 180 and is held in place by the magnets 182. The edges of the can end are guided laterally by the cam supports 184. The engagement of the end 82 on the rails 180 in effect peels the end off of the feeder wheel magnets 162. The end is stationary momentarily until the dog 160 catches up and begins to push the end down the rails 180. All of the above-described actions are, of course, simultaneously taking place at each feeder system 86 on either side of the wheel 20.

As the wheel 20 rotates, it successively carries the work piece holders 70 into the area of the pickup assemblies 171. When the fingers 72, 74 of a particular work piece holder enter the pickup assemblies, the fingers engage the cams 186, 188. The cams flex the free ends of the fingers toward one another, as best seen in FIG. 8. The free ends are flexed sufficiently to locate them between the curl and vertical wall of a can end. The rails 180 are shaped to tangentially feed a work piece until it is adjacent the flexed free ends of the fingers. At this point, the cams release the fingers such that the free ends tend to return to their normal, rest position. They are, of course, unable to do so because they are trapped by the curls of the can ends. Thus, the ends are held on the fingers in spring-loaded, gripping relation.

When the ends are fully engaged o the fingers at the pickup point, the pin 81 will just barely touch the back edge of the end. This serves as a secondary holding device to assist in retaining the ends as they move around the wheel. Also, the pins 81 will push the ends into the discharge tracks 110 after the ends have been pulled off of the fingers.

The timing of the transfer chain 88 and the work piece holders 70 is such that the transfer to the holders is complete at a pickup point, the center line of which is shown at 190 in FIGS. 6 and 7. Once the work pieces are attached to the work piece holders, the wheel 20 carries them down into the bath 104. As the brushes 64 of a particular work piece holder contact the busses 66 and 68, an electric current flows between the can ends and the electrode 84. This causes the electrode position process to take place. Continued rotation of the wheel 20 carries the brushes out of contact with the busses, thereby ending electrode-position. By controlling the arcuate length of the busses, the amount of time of current flow can be controlled.

Continued rotation of the wheel 20 lifts the work pieces out of the bath and eventually carries them to the discharge conveyor 106. The ends enter the tracks 110 formed in rails 108. The cam surface 112 of the tracks pulls the can ends off of the fingers, allowing the ends to roll freely down the rails 108, to the extent permitted by the chain fingers 114. From the discharge conveyor, can ends enter the rinse conveyor 120 and proceed through the rinse tanks in the normal manner.

Several advantages of the present invention can now be pointed out. It is evident, for example, that the fingers provide a work piece holder of utmost simplicity. There are no moving parts or complex mechanisms to become fouled in the bath. Also, the brush and bus arrangement provides precise control over the length of time for electrocoating to take place. A further advantage of the invention is that the transfer means, including the pickup assemblies, present the work pieces to the fingers in a tangential direction. This facilitates meshing of the fingers inside the curls of the can ends.

It should be pointed out that while the cams of the present invention are arranged to push the fingers toward one another, it could be otherwise, depending on the shape of the work piece. It may be advantageous to cam the free ends of the fingers apart so they will clamp together on a work piece. The present invention contemplates either arrangement. Whereas a preferred form of the invention has been shown and described, it will be realized that alterations may be made thereto without departing from the scope of the following claims.

We claim:

1. Apparatus for electrocoating work pieces, comprising:

a frame;

a tank connected to the frame and containing an electrocoating solution;

a wheel mounted for rotation on the frame and disposed partially within the electrocoating solution;

a plurality of work piece holders spaced around the wheel, each holder comprising a pair of spaced, flexible fingers each cantilevered from the wheel to define a free end on each finger for engaging a work piece;

cam means for displacing the free ends of the fingers from their normal, rest positions and then releasing the fingers;

transfer means for placing a work piece adjacent the displaced fingers at a pickup point such that upon release of the fingers they engage the work piece in spring-loaded, gripping relation.

2. The apparatus of claim 1 wherein the cam means displaces the free ends of the fingers toward one another.

3. The apparatus of claim 1 wherein each finger comprises a thin strip of metal affixed to the wheel.

4. The apparatus of claim 1 wherein each finger is affixed to the wheel intermediate its ends, generally parallel to the axis of the wheel such that the finger extends on either side of the wheel.

5. The apparatus of claim 4 wherein the cam means and transfer means are operable on both sides of the wheel to place work pieces on both sets of free ends of the fingers.

6. The apparatus of claim 1 wherein the transfer means comprises a conveyor which carries work pieces to the pickup point such that at the pickup point the work pieces have a component of motion parallel to the direction of wheel rotation and a component of motion perpendicular to the wheel.

7. The apparatus of claim 6 wherein the conveyor includes at least one feeder wheel having a magnetic rim for engaging work pieces and carrying them toward the pickup point.

8. The apparatus of claim 6 wherein the conveyor further comprises a set of guide rails which channel the work pieces to the pickup point.

9. The apparatus of claim 1 further comprising discharge means for removing work pieces from the work piece holders.

10. The apparatus of claim 1 further comprising an electrode associated with each work piece holder, a plurality of first electrical conductors, one connected to each work piece holder for imparting a charge thereto- and a plurality of second electrical conductors, one connected to each electrode for imparting a charge to the electrode opposite that on the work piece holder.

11. The apparatus of claim 10 wherein each of the first and second conductors terminates at an electrical brush, and further comprising first and second electrical busses engageable with the brushes of the first and second conductors, respectively, for supplying an electrical charge to he conductors.

12. The apparatus of claim 11 wherein the brushes are arcuately spaced and the busses are shaped so as to contact the brushes only when the corresponding work piece holder is immersed in the electrocoating solution.

13. Apparatus for transporting work pieces, comprising:

a frame;

a carrier mounted for movement on the frame;

a plurality of work piece holders attached to the carrier, each holder comprising a pair of spaced, flexible fingers each cantilevered from the carrier to define a free end on each finger for engaging a work piece;

cam means for displacing the free ends of the fingers toward one another from their normal, rest positions and then releasing the fingers;

transfer means for placing a work piece adjacent the displaced fingers at a pickup point such that upon release of the fingers they engage the work piece in spring-loaded, gripping relation.

14. The apparatus of claim 13 wherein each finger comprises a thin strip of metal affixed to the carrier.

15. The apparatus of claim 13 wherein the carrier comprises a disk having first and second sides, and wherein each finger is affixed to the carrier intermediate the ends of the finger, such that the finger extends laterally beyond each side of the carrier.

16. The apparatus of claim 15 wherein the cam means and transfer means are disposed adjacent to both sides of the carrier and are operable to place work pieces on both sets of free ends of the fingers.

17. The apparatus of claim 13 wherein the transfer means comprises a conveyor which carries work pieces to the pickup point such that at the pickup point the work pieces have a component of motion parallel to the direction of wheel rotation and a component of motion perpendicular to the wheel.

18. The apparatus of claim 17 wherein the conveyor includes at least one feeder wheel having a magnetic rim for engaging work pieces and carrying them toward the pickup point.

19. The apparatus of claim 17 wherein the conveyor further comprises a set of guide rails which channel the work pieces to the pickup point.

20. The apparatus of claim 13 further comprising discharge means for removing work pieces from the work piece holders.

21. The apparatus of claim 13 wherein each finger comprises a thin strip of metal affixed to the wheel and having at least one notch at the free end thereof.

* * * * *